United States Patent [19]

Kreith et al.

[11] 4,236,578

[45] Dec. 2, 1980

[54] HEAT EXCHANGE ENHANCEMENT STRUCTURE

[75] Inventors: Frank Kreith, Boulder, Colo.; Richard C. Cornelison, Hiram, Ohio

[73] Assignee: Condar, Co., Hiram, Ohio

[21] Appl. No.: 902,848

[22] Filed: May 4, 1978

[51] Int. Cl.[3] ..... F28F 1/20

[52] U.S. Cl. ..... 165/181; 29/157.3; 113/118 A; 165/185

[58] Field of Search ..... 403/304, 344; 165/77, 165/181-184, 55; 29/157.3 AH, 313; 113/118 A, 118 B

[56] References Cited

U.S. PATENT DOCUMENTS

| | | | |
|---|---|---|---|
| 1,932,610 | 10/1932 | Tilley | 165/184 |
| 2,400,737 | 5/1946 | Brown, Jr. | 165/182 |
| 2,625,804 | 1/1953 | Patch et al. | 165/77 X |
| 3,333,317 | 8/1967 | Shockley | 29/157.3 A |

FOREIGN PATENT DOCUMENTS

| | | | |
|---|---|---|---|
| 843236 | 8/1960 | United Kingdom | 165/184 |
| 188998 | 11/1966 | U.S.S.R. | 165/183 |

*Primary Examiner*—Samuel Scott
*Assistant Examiner*—Theophil W. Streule, Jr.
*Attorney, Agent, or Firm*—Fay & Sharpe

[57] ABSTRACT

A passive heat exchange enhancement structure which operates by free convection includes a flat mounting portion having a plurality of integral fins bent outwardly from one side edge thereof. The mounting portion is securable around a stovepipe, to a flat surface or the like for transferring heat from the pipe through the fins to the surrounding air by rotation-enhanced free convection.

14 Claims, 12 Drawing Figures

HEAT EXCHANGE ENHANCEMENT STRUCTURE

BACKGROUND OF THE INVENTION

This application relates to the art of heat exchange enhancement structures and, more particularly, to finned heat exchange enhancement structures which operate by free convection using fins having a large surface area for transferring heat and making contact with a quiescent fluid.

The heat exchange enhancement structure of the present application is particularly applicable for use in transferring heat from a hot stovepipe, fluepipe or the like by rotation-enhanced free convection to the quiescent air of a room in which the stovepipe is located. However, it will be appreciated by those skilled in the art that the improved heat exchange enhancement structure has broader aspects and may be used for transferring heat in other environments.

It is known to be advantageous to utilize heat energy from hot gases passing through a stovepipe or the like to assist in heating a room or other associated space. However, such energy is ordinarily substantially lost to the atmosphere and performs very little in the way of any useful heating function during the passage of the hot gases through the pipe. If heat could be more efficiently communicated from the pipe to the space which is to be heated, the associated stove or furnace would be more energy efficient. This result is deemed to be particularly advantageous and significant due to the fact that the availability of some types of fuels is decreasing while the costs therefor are ever increasing.

BRIEF DESCRIPTION OF THE INVENTION

In accordance with the present new development, there is provided a free convection type heat exchange enhancement structure operable by rotation-enhanced free convection. The heat exchange enhancement structure includes an elongated flat mounting portion having opposite side edges. A plurality of fins integral with the mounting portion extend outwardly from at least one of said side edges thereof. The fins are bent adjacent the one side edge to extend transversely to the plane of the mounting portion.

In one arrangement, the heat exchange enhancement structure is made of sheet aluminum which is covered with a black coating to render it a very good infrared emitter. The aluminum sheet is obtained in a coil and is then uncoiled to present a flat sheet on which cutting and forming operations are performed.

The fins of the heat exchange enhancement structure preferably have a substantially uniform width along their entire length.

The plurality of adjacent fins which extend from a predetermined longitudinal length of the one side edge on the mounting portion have a combined width which is substantially equal to the predetermined longitudinal length of the one side edge. With this arrangment, there is little or no waste of material in making the improved heat exchange enhancement structure from a flat sheet of metal which is uncoiled from a coil.

The fins have opposite fin edges and are twisted or turned about their longitudinal axes so as to locate one fin edge facing outwardly in the same general direction as the one side edge of the mounting portion and to locate the other fin edge facing outwardly in the same general direction as the other side edge of the mounting portion. This arrangement exposes the flat faces of the fins both longitudinally and transversely to the mounting portion.

The mounting portion has opposite ends and integral mounting means formed on the mounting portion inwardly from its opposite ends. The mounting means may include bosses formed outwardly of the mounting portion in the same general direction in which the fins extend therefrom. The bosses have openings facing outwardly opposite from the ends of the mounting portion. End coils on a coil spring may be received directly through the openings for location beneath the bosses for providing a very quick mounting for the heat exchange enhancement structure on a stovepipe, fluepipe or the like. The spring places the mounting portion in tension so it firmly engages the pipe around which it is mounted. The end coils of the coil spring may be received through openings in hook brackets which are hooked to the bosses.

Elongated stiffening ribs are formed in the mounting portion along opposite sides of the bosses forming the mounting means. These stiffening ribs extend outwardly from the mounting portion in the same direction as the bosses and inhibit creasing or undesirable deformation of the mounting portion in the area of the bosses.

An optional variation includes a plurality of equidistantly-spaced screw receiving holes formed along the length of the mounting portion for receiving screws which extend well into a stovepipe, fluepipe, flat surface or the like. These screws firmly hold the mounting portion in contact with the stovepipe or other surface to provide good heat conduction. The screws themselves are in contact with the hot gases flowing through the stovepipe and transfer heat to the heat exchange enhancement structure for outward dissipation by the fins into the surrounding air of a room. The screws are preferably of a high heat transfer material such as steel or aluminum.

In one arrangement, the fins are bent to extend at an included angle with the plane of the mounting portion of between 60° and 85°. More specifically, the fins preferably extend at an included angle of between 70° to 85° with the mounting portion after being bent through combined angles of approximately 95° to 110°. With this arrangement, the fins overlay at least a portion of the mounting portion outwardly thereof when the heat exchange enhancement structure is installed on a stovepipe.

The fins are preferably bent along a plurality of straight lines in order to provide them with the desired twist and shape. This arrangement makes it much easier to form the fins and no compound bends are necessary. At least one of the straight line bends is effective to turn the fins about their axes at an angle less than 90° so that the projection areas of the opposite faces of the fins toward the opposite side edges of the mounting portions are less than the actual width of the fins.

The heat exchange enhancement structure is made from a substantially rectangular metal sheet unwound from a coil. The sheet is worked by forming a plurality of equidistantly-spaced parallel cuts, slits or lances in the sheet extending from one longitudinal edge thereof toward the other and terminating short of the other to define the mounting portion. Each slit extends at an angle to the mounting portion of preferably between 45° to 70°. Each fin has a fin span or base along the one side edge of the mounting portion and has an acute fin edge intersecting the one side edge of the mounting portion at an acute angle. Each fin includes an opposite obtuse fin edge intersecting the one side edge of the mounting portion at an obtuse angle. Each fin is bent along a first bend line extending generally from the intersection of the acute fin edge with the span or base to an intersection point with the obtuse fin edge spaced outwardly from the span. Each fin is bent along a second bend line defined by the span and also preferably bent along the first bend line to position the fin edges substantially perpendicular to the span or to the one side edge of the mounting portion as viewed in plan view.

The intersection point between the first bend line and the obtuse fin edge is located generally toward the midpoint area of the span or base of each fin outwardly along the obtuse fin edge. The fins are bent about the second bend lines through an angle of approximately 55° to 85°.

In its installed form on a stovepipe or the like, the heat exchange enhancement structure has a substantially flat cylindrical mounting portion with opposite circular edges and a longitudinal axis. A plurality of fins are integrally formed with the mounting portion and are bent outwardly from at least one of the circular edges. The fins are bent to have opposite fin edges lying generally on the surfaces of cones having axes coincidental with and spaced along the longitudinal axis of the mounting portion. The structure is mounted on a generally vertically disposed cylindrical pipe such as a stovepipe, fluepipe or the like with the apices of the cones pointing upwardly. The cones preferably slope upwardly from their bases toward their apices at an angle of approximately between 5° and 30° from a horizontal plane passing through the generally vertical pipe.

In its installed position on any surface, the heat exchange enhancement structure has a substantially flat mounting portion with a plurality of integral fins bent outwardly from at least one of the edges on the mounting portion. The fins are turned about their axes so the projection area of one face of the fins generally outwardly of one edge is generally the same as the projection area of the opposite face of the fins generally outwardly of the other edge. The fins are turned or twisted about their longitudinal axes approximately 45° to 70° in order to accomplish this desirable arrangement which induces maximum air flow between and over the fins. Hot air swirls outwardly between the fins so cold air is induced to flow in toward the stovepipe, fluepipe, flat surface or the like as well as toward the heat exchange enhancement structure.

It is a principal object of the present development to provide an improved finned heat exchange enhancement structure which operates by free convection, and provides an improved free convection air flow pattern which swirls hot air into the surroundings, induces colder air from the surroundings and thereby increases heat transfer performance from a pipe or other surface containing or associated with a heated fluid.

It is also an object of the development to provide an improved finned heat exchange enhancement structure which is very simple to manufacture and install.

It is an additional object of the development to provide an improved finned heat exchange enhancement structure which maximizes free convection air flow between and over the fins while also maximizing heat transfer by radiation from the fins to the surroundings which may include people, walls and the like.

It is a further object of the development to provide an improved method of manufacturing a finned heat exchange enhancement structure.

Still further objects and advantages for the subject new development will become apparent to those skilled in the art upon a reading and understanding of the specification.

BRIEF DESCRIPTION OF THE DRAWING

The invention may take form in certain parts and arrangements of parts, a preferred embodiment of which will be described in detail in this specification and illustrated in the accompanying drawings which form a part hereof and wherein.

DESCRIPTION OF A PREFERRED EMBODIMENT

Figure 1:
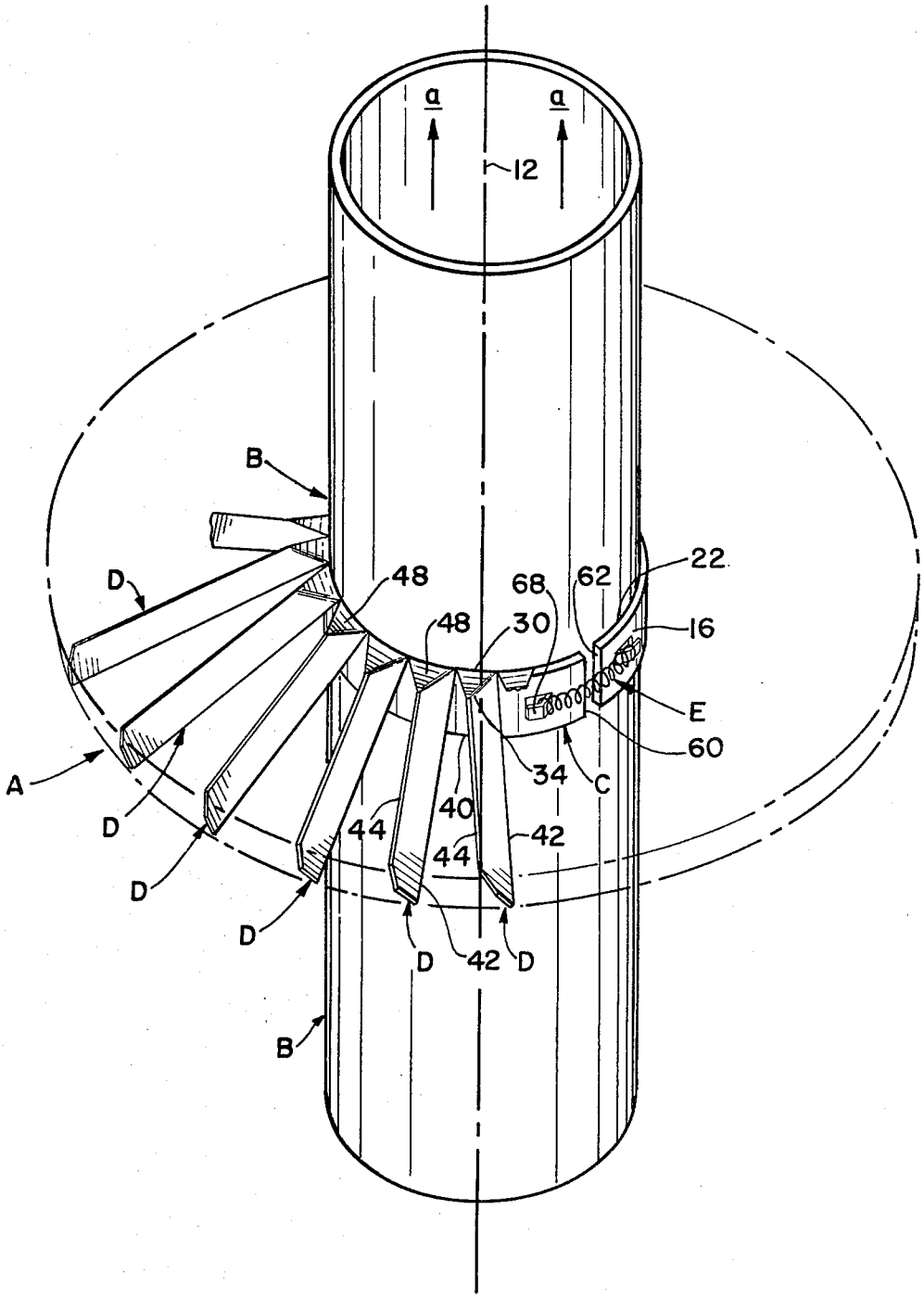
FIG. 1 is a perspective illustration of a stove pipe having the improved heat exchange enhancement structure of the present application installed thereon.

Referring now to the drawings wherein the showings are for purposes of illustrating the preferred embodiment of the invention only and not for purposes of limiting same, FIG. 1 shows a heat exchange enhancement structure A constructed in accordance with the present application installed on a generally vertically disposed cylindrical stovepipe, fluepipe or the like B which would normally be connected to a wood burning stove or any other apparatus producing heat and hot gases which are exhausted through pipe B. As shown in FIG. 1, the hot gases flow in the direction of arrows a. Although shown and hereinafter described with reference to a cylindrical stovepipe or the like, it will be appreciated that the concepts of the subject development are equally applicable to use with other types and styles of surfaces.

Heat exchange enhancement structure A includes a flat mounting portion C having a plurality of integral fins D bent outwardly from one edge thereof. Mounting portion C has a generally cylindrical configuration with a longitudinal axis coincidental with longitudinal axis 12 of cylindrical pipe B. Fins D are circumferentially-spaced and extend outwardly from mounting portion C for transferring heat to a room in which pipe B is located. In the preferred arrangement, heat exchange enhancement structure A is constructed of sheet aluminum which is painted or otherwise coated with a black coating, although other materials and arrangements could be advantageously employed without in any way departing from the overall intent or scope of the present development. The aluminum sheet is unwound from a coil of sheet aluminum during the manufacturing procedure. Hot gases inside the pipe transfer heat by convection and radiation to the interior surfaces of the pipe, thence through the pipe to the enhancement structure mounting portion and fins. Heat is finally transferred to the air by convection and to people, objects and walls in the room by radiation. Heat exchange enhancement structure A is a very good emitter of infrared radiation and a plurality of series of heat exchange enhancement structures are preferably used and mounted similar to the one heat exchange enhancement structure shown in FIG. 1 at longitudinally-spaced apart locations or intervals along a vertical length of pipe B. When so installed, each enhancement structure is preferably positioned along the pipe relative to the next adjacent enhancement structure in a manner such that the mounting portions are closely adjacent each other or are spaced apart from each other up to a distance which is generally equal to the length of fins D. Therefore, hot, buoyant air swirls upwardly and outwardly between fins D on the lower positioned heat exchange enhancement structure A. This induces the flow of cooler air toward the heat exchange enhancement structures by free convection. Moreover, it may also be desirable from a heat transfer point of view to mount the enhancement structures A in a manner such that the fins of each structure are offset relative to the fins of the next adjacent structure by up to one half pitch. While the description appearing hereinafter relates to a single heat exchange enhancement structure A, it will be appreciated that the others in the series are substantially identical thereto.

Figure 2:
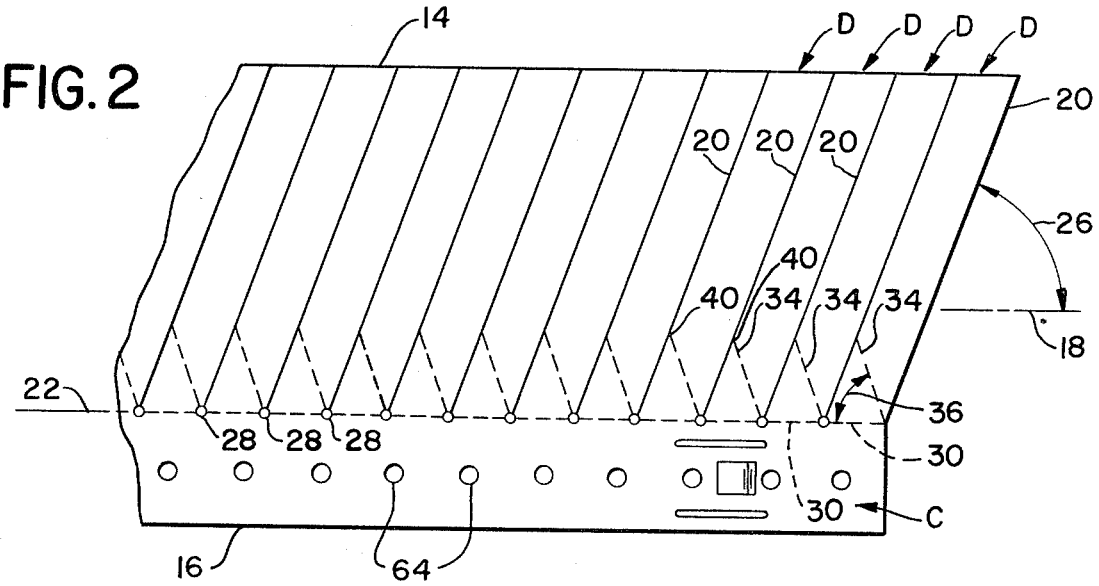
FIG. 2 is a partial plan view of a flat metal sheet having cuts formed therein in an intermediate stage of manufacturing the improved heat enhancement structure.

FIG. 2 shows a flat metal strip having opposite parallel longitudinal edges 14,16 and a longitudinal axis 18. A plurality of equidistantly-spaced parallel cuts, slits or lances 20 are formed in the strip extending from longitudinal edge 14 toward longitudinal edge 16 and terminating short thereof generally along a line 22 extending parallel to longitudinal edge 16. That portion of the metal strip between edge 16 and line 22, which is substantially smaller then the portion between line 22 and edge 14, defines a mounting portion C. Line 22 represents one ultimate side edge of mounting portion C and longitudinal edge 16 of the metal strip defines the other side edge.

In a preferred arrangement, cuts 20 extend at an included angle 26 with longitudinal axis 18. This angle may vary between 30° and 80° and most preferably will generally be in the range of 45° and 70°. In the arrangement shown, each terminal end of a cut 20 at line 22 is provided with a small circular hole 28 for ease in deforming the metal in a manner to be described. Fins D have a uniform width along their entire length and are defined between each adjacent pair of parallel cuts 20. Fins D have fin spans or bases 30 defined along line 22 between each adjacent pair of holes 28 or between the inner terminal ends of cuts 20 along the one side edge of mounting portion C.

Although the length of spans 30 may vary, it has been found desirable to space cuts 20 so that the bases or spans are approximately equal to 0.410″ or 0.440″. This arrangement allows for the accommodation of the number of fins required to surround the pipe with substantially the same spacing between the fins at each end of mounting portion C as is found between all the other fins when the heat exchange enhancement structure is installed and does not require any change or variation in the span length to properly accommodate the most common stovepipe or fluepipe diameters of 6″, 8″ and 10″. Merely by way of example, and when spans 30 are 0.410″ in length, the heat exchange enhancement structure will have forty-six (46) fins when used on a 6″ diameter pipe, sixty-one (61) fins when used on an 8″ diameter pipe and seventy-seven (77) fins when used on a 10″ diameter pipe to achieve the above noted ultimately desired spacing between the end fins. Thus, it is not necessary to adjust or have separate dies for manufacturing the subject heat exchange enhancement structure for adoption to use with at least the most commonly used of the conventional stovepipe, fluepipe and the like diameters. Moreover, and in conjunction with the preferred span lengths, these lengths are such that intimate heat transfer contact between the pipe and enhancement structure is substantially maintained at the span areas. It is, however, possible to vary the aforementioned dimensional characteristics without in any way departing from the overall intent or scope of the subject development.

Fins D are bent along straight first bend lines 34 which extend at an angle 36 in the range of 50° to 80° to line 22 or a span 30. An acute edge of each fin D may be considered the edge which intersects line 22 at an included acute angle. The opposite edge of each fin may be considered as intersecting side edge 22 of mounting portion C at an obtuse included angle. The included acute and obtuse angles are supplementary to each other. Thus, one edge of each fin D may be considered as an acute fin edge 42, while the opposite parallel fin edge may be considered as an obtuse fin edge 44. Each bend line 34 extends from the intersection of the acute fin edge with a span 30 toward the obtuse fin edge to intersect same at an intersecting point 40 spaced outwardly from span 30. In the particular arrangement shown in the FIGURES, angles 26,36 are equal to each other so that each intersecting point 40 also bisects a span 30. In other words, an isosceles triangular area 48 is defined by span 30, line 34 and that portion of a cut 20 between intersection point 40 and a hole 28. However, it is not necessary to have angles 26,36 equal to each other within the preferred ranges therefor as set forth above. In the event they are not equal, intersecting point 40 would then only fall generally toward the midpoint area of the associated span 30.

Figure 3:
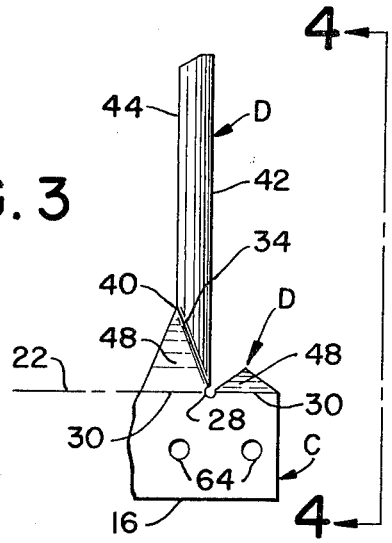
FIG. 3 is an enlarged partial plan view showing the portion of the sheet in FIG. 2 after fins have been bent in successive stages.

The left side of FIG. 3 shows a fin D after it has been bent along first bend line 34 to a position in which acute fin edge 42 and opposite obtuse fin edge 44 extend substantially perpendicular to side edge 22 of mounting portion C as viewed in plan view. Depending upon the particular angle selected from within the preferred range set forth above for angle 36, the fin will be bent along bend line 34 at an angle generally in the range of 45°-75° relative to the plane of triangular area 48 in order that the fin will assume this particular position.

Figure 4:
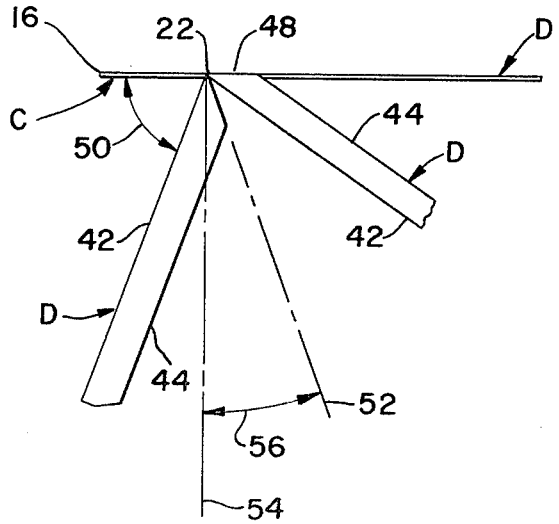
FIG. 4 is an end elevational view taken generally along lines 4—4 of FIG. 3.

Subsequent to the bending of each fin D along first bend lines 34, they are then bent about spans 30 through an angle of approximately 55°-85° to assume a final position as shown at the right side of FIG. 3. In FIG. 4, the left-most fin is in the final position, and the right-most fin is in the intermediate position after bending only along first bend line 34 of FIGS. 2 and 3. Triangular areas 48 remain adjacent spans 30 as best shown in FIG. 3 after complete bending of the fins.

The final bending of each fin leaves acute fin edge 42 spaced from mounting portion C at an included angle 50 of between 60°-85°. Triangular area 48 lies in plane 52 intersecting a line 54 perpendicular to mounting portion edge 22 at an angle 56 generally in the range of 5°-35°. Preferably, each fin is bent through combined angles so that angle 50 is between approximately 70° and 85°.

Bending of each fin D along first bend line 34 to locate the fin edges substantially perpendicular to mounting portion C in the manner described above has the affect of turning or twisting each fin about its longitudinal axis. Each fin remains planar so that there is no curving of the metal and the bend is carried out in a manner such that the projected areas of the flat faces of each fin parallel to axis 12 is reduced. Also, the opposite flat faces of each fin D face both longitudinally and transversely of mounting portion C. Although each fin may be turned or twisted about its longitudinal axis to differing degrees by varying angle 36 within the 50°-80° set forth above and then adjusting the angle of bend about bend line 34 within the 45°-75° range as also set forth above in order that the fin edges will be located substantially perpendicular to mounting portion C, the preferred degree or angle of twist is approximately in the range of 60°-65°. This preferred range takes into full account the optimum convection heat transfer fin twist angle of 45°-70° for inducing the maximum air flow and transferring maximum heat by means of convection to the air flow on either side of the fins.

In the finished heat exchanger, the projected area of the fin flat faces which face toward side edge 22 is approximately the same as the projected flat face area which faces generally outwardly of side edge 16. In addition, the ratio of the projected area of the fins to the total projected area of the fins and spaces therebetween for the particular angular ranges set forth above has been found to optimize heat transfer and air flow between the fins. Of all the various angular range relationships specified above for the subject heat exchange enhancement structure, the most important ones from an advantageous operational point of view are cut angle 26, the fin twist angle as defined by angle 36 about bend line 34 and the fin downward bend angle about span 30. The other angles are primarily construction angles which allow for practical and easy manufacture of the overall structure by conventional metal working techniques such as, for example, in a progressive type die.

Figure 5:
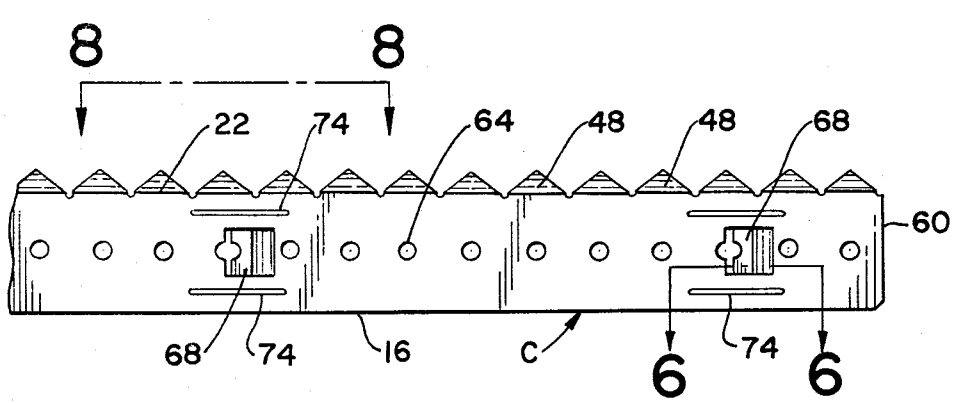
FIG. 5 is a plan view of a completed heat exchange enhancement structure.

FIG. 5 shows a mounting portion C which has been cut to a predetermined longitudinal length between opposite ends 60,62. A plurality of longitudinally-spaced screw receiving holes 64 are formed through mounting portion C generally centrally thereof. This feature allows a plurality of elongated heat conductive screws to be inserted through the mounting portion and into pipe B for enhancing the heat transfer characteristics from the heated gases to the heat exchanger device. These screws also aid in retaining mounting portion C in a close fitting relationship with pipe B to enhance the heat transfer characteristics therebetween. However, and if desired, it is possible to dispense with using the hole 64 and screw arrangement.

Figure 6:
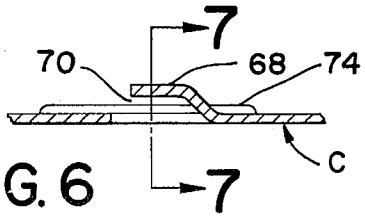
FIG. 6 is a partial cross-sectional elevational view taken generally along lines 6—6 of FIG. 5.
Figure 7:
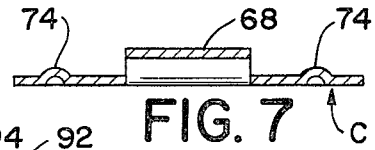
FIG. 7 is a cross-sectional elevational view taken generally along lines 7—7 of FIG. 6.

Separate mounting means is also formed integrally with mounting portion C for mounting same in a cylindrical configuration around pipe B of FIG. 1. This mounting means is in the form of bosses 68 formed outwardly of mounting portion C in the same general direction in which the fins extend outwardly from mounting portion C. Bosses 68 are spaced inwardly from opposite ends 60,62 and as best shown in FIG. 6, have openings 70 which face in a direction opposite from the most adjacent end 60 or 62. For example, boss 68 adjacent end 60 has an opening 70 which faces toward end 62 and boss 68 adjacent end 62 has an opening 70 which faces toward end 60. As shown in FIG. 5, three bosses 68 are spaced along mounting portion C. The middle one of these bosses is spaced more closely to end 60 and has its opening facing toward end 62. This boss is employed as an alternate mounting boss for less common pipe diameters of, for example, 5", 7" and 9". When used, that material of the enhancement structure located between the middle boss and end 60 as viewed in FIG. 5 is simply cut off and discarded. This then has the advantage of allowing a relatively few basic sizes of mounting portions C to be readily adapted to fit all common, standard pipe sizes.

Small elongated stiffening ribs 74 are also deformed outwardly from mounting portion C on opposite sides of bosses 68. Ribs 74 extend only generally along bosses 68 and not along the entire length of mounting portion C. Ribs 74 stiffen mounting portion C in the area of bosses 68 to prevent wrinkling or undesirable deformation of the mounting portion when a mounting device is attached to bosses 68. With this construction, the rear side of mounting portion C which is visible in FIG. 5 is completely flat for positioning against pipe B of FIG. 1 and obtaining a good heat transfer relationship.

Figure 10:
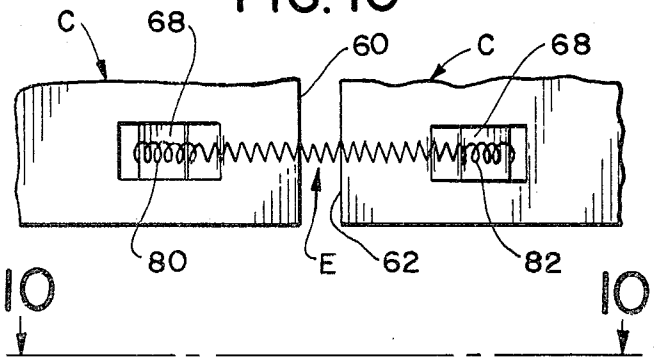
FIG. 10 is a plan view taken generally along lines 10—10 of FIG. 9.
Figure 9:
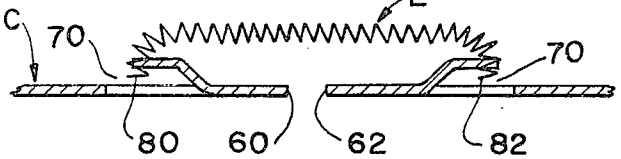
FIG. 9 is an edge elevational view showing one means for joining the opposite ends of the heat exchange enhancement structure together.

FIGS. 9 and 10 show a coil spring E which is in tension and has opposite end coils 80 and 82 positioned beneath bosses 68 by extending through the outwardly facing openings 70 therein. Coil spring E is tensioned so that it urges opposite ends 60,62 toward one another thereby placing mounting portion C under tension around pipe B. Coil spring E in the form of an adjustable tensioning mounting device can take other forms if so desired.

Figure 11:
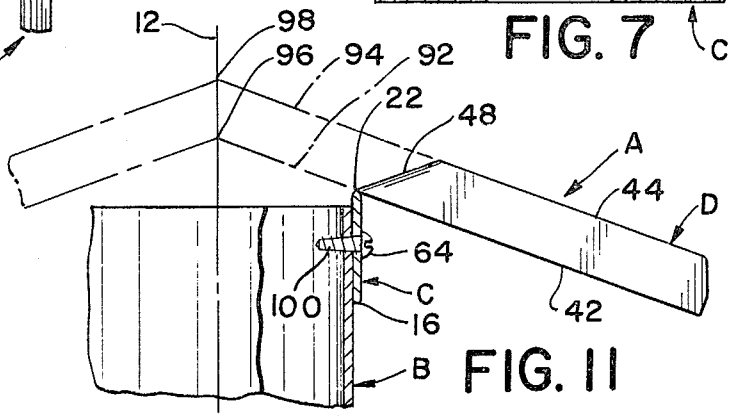
FIG. 11 is an elevational view of a heat exchange enhancement structure showing the relationship of the fin edges to a pair of cones and the longitudinal axis of the cylindrical mounting portion on the heat exchange enhancement structure; and, FIG. 12 is a partial view similar to FIG. 9 and showing a modified arrangement for joining together the opposite ends of the heat exchange enhancement structure.
Figure 8:
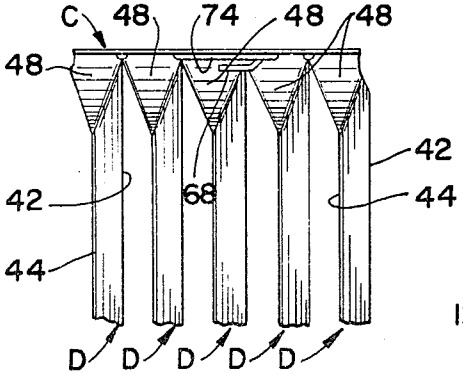
FIG. 8 is a partial edge elevational view taken generally on lines 8—8 of FIG. 5.

FIG. 11 shows the heat exchanger enhancement structure configuration when it is positioned around a cylindrical pipe such as a stovepipe, fluepipe or the like. Mounting portion C is shaped to a substantially cylindrical configuration having a longitudinal axis corresponding to axis 12 for pipe B of FIG. 1. The opposite side edges 16,22 of the mounting portion may also be considered opposite circular edges when it is in its cylindrical configuration. Fins D are integral with mounting portion C and bent outwardly therefrom about one circular edge 22 in the manner previously described. With this arrangement, opposite fin edges 42 and 44 lie on the surfaces of axially-spaced cones 92,94 having apices 96,98 coincidental with longitudinal axis 12. Due to the twisting of the fins about their longitudinal axes, cones 92,94 are axially spaced from each other along longitudinal axis 12 a distance less than the actual face width of the fins. Cones 92,94 slope upwardly toward their apices 96,98 from their bases at angles generally in the range of 5°-30° and more preferably in the range of 5°-20°. Here also, heat conductive screws are employed to affix the heat exchanger to pipe B as discussed hereinabove. One such screw 100 is shown in FIG. 11 passing through an associated hole 64 in mounting portion C and penetrating pipe B. A plurality of similar screws are spaced peripherally around and similarly penetrate the pipe. In the mounted position, good heat transfer results are obtained by conduction alone between the outside surface of the stovepipe and the inside surface of mounting portion C. In addition, some portion of the heat transfer between the two surfaces may also take place by radiation.

The arrangement shown and described for making heat exchange enhancement structure A results in little or no waste of material. For a given predetermined longitudinal length of side edge 22 on mounting portion C, a plurality of fins D occupying that predetermined longitudinal length have an actual total fin width which is the same as the predetermined longitudinal length. This is because the fins are formed by cutting, slitting or lancing and then bending so that no material is removed and wasted during manufacture. This also results in optimum area for heat transfer along with optimum spacing between fins for enhanced air flow.

The ultimate position of each fin D is preferably as shown in FIG. 11. Due to the preferred upward slope of cones 92,94, fins D will, to some extent, overlay mounting portion C outwardly thereof to receive heat therefrom. However, it will be recognized that a number of modifications are possible. For example, and with reference to FIG. 4, instead of bending each fin D from the right position shown to the left position shown, it is possible to bend each fin so that it extends to the right of line 54 at the preferred angle. In such an arrangement, heat exchange enhancement structure A would be installed in an inverted position with fin D still extending downwardly but spaced outwardly from the pipe itself and with mounting portion C above the fins instead of beneath them. The preferred arrangement, however, is that the fins extend downwardly from the upper circular edge of the mounting portion. In the final installed position of the heat exchanger, the lower edges of the fins make an included angle with the pipe of approximately 60°-85°.

Figure 12:
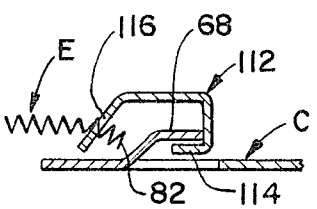
Figure 5:
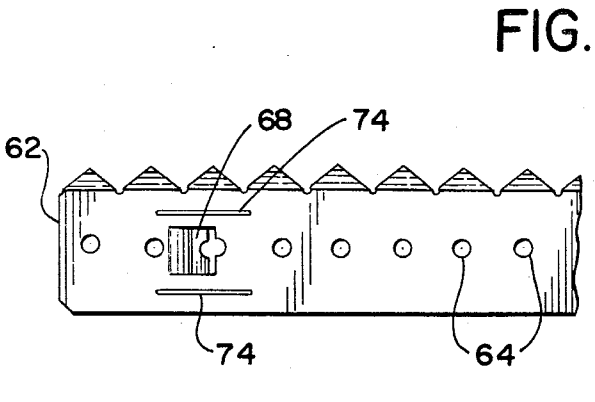

FIG. 12 shows an example of another mounting arrangement. Hook bracket 112 has an opening 116 receiving end portion 82 of coil spring E, and a hook 114 is positioned beneath boss 68. A corresponding hook bracket on the other end of spring E is similarly attached to the other end portion of the heat exchange enhancement structure.

The heat exchange enhancement structure can also be secured to pipes and other structures by other mounting arrangements than those disclosed. For example, the heat exchange enhancement structure could be welded to a pipe or other structure or could be placed thereon in a continuous spiral. The heat exchange enhancement structure could also be secured directly to barrel stoves and other structures instead of being secured to pipes. It is not necessary that the heat exchange enhancement structure extend 360° around the pipe, stove or other structure. The heat exchange enhancement structure can also be used on heat exchange elements, pipes and the like of the type used in power plants and process plants as well as in other environments where heat dissipation is necessary and/or desirable.

The new heat exchange enhancement structure and method has been described with reference to the preferred embodiment which transfers heat by rotation-enhanced free convection. Obviously, modifications and alterations will occur to others upon the reading and understanding of this specification. It is intended to include all such modifications and alterations insofar as they come within the scope of the appended claims or the equivalents thereof.

Having thus described the development, it is now claimed:

1. A free convection type heat exchange enhancement structure comprising: an elongated flat mounting portion having opposite side edges; a plurality of fins integral with said mounting portion and extending outwardly from at least one of said side edges thereof; each said fin having a longitudinal fin axis, opposite fin faces, opposite fin edges and a substantially uniform width along its length; each said fin adjacent said one side edge of said mounting portion having a plurality of straight line bends therein about which each said fin is positioned extending transversely of the plane of said mounting portion and turned about said axis through an angle substantially less than 90° for positioning said flat faces with the projected area thereof toward said opposite side edges of said mounting portion being substantially greater than the thickness of each said fin but substantially less than the width of each said fin; each said fin, prior to bending thereof about said plurality of straight line bends, having said fin edges thereof inclined substantially out of perpendicular relationship to said one side edge of said mounting portion; and, each said fin being bent about each said bend in the same direction with respect to said mounting portion.

2. The heat exchange enhancement structure as defined in claim 1 wherein said mounting portion has opposite ends and includes integral mounting means spaced inwardly from said ends, said mounting portion being curved to a generally cylindrical configuration for positioning around a cylindrical pipe, and adjustable tensioning means cooperating with said mounting means for tensioning said mounting portion around a pipe.

3. The heat exchange enhancement structure as defined in claim 1 wherein said mounting portion has opposite ends and including integral mounting bosses formed outwardly of said mounting portion in the same general direction in which said fins extend from said mounting portion, each said boss having an opening facing outwardly in a direction opposite from the end adjacent which it is located, and said bosses being engageable by tensioning means for tensioning said mounting portion in a curved position around a pipe.

4. The heat exchange enhancement structure as defined in claim 3 including elongated stiffening ribs in said mounting portion extending at least along opposite sides of said bosses substantially parallel to said opposite edges of said mounting portion, and said ribs being formed outwardly from said mounting portion in the same direction as said bosses.

5. The heat exchange enhancement structure as defined in claim 1 wherein said plurality of straight line bends include a first bend extending along said one side edge of said mounting portion, each said fin being positioned about said first bend at an included angle with the plane of said mounting portion of between 60° and 85°.

6. The heat exchange enhancement structure as defined in claim 5 wherein each said fin is bent approximately 95° to 110° about said first bend and extends at an included angle with said mounting portion of between 70° to 85°.

7. The heat exchange enhancement structure as defined in claim 1 wherein said plurality of straight line bends include a first bend extending along said one side edge of said mounting portion and about which each said fin is positioned extending transversely of the plane of said mounting portion and a second bend extending from one end of said first bend across said fin at an included acute angle with said first bend of substantially less than 90°.

8. The heat exchange enhancement structure as defined in claim 1 wherein said structure is made from a substantially rectangular metal sheet by forming a plurality of equidistantly spaced parallel slits in said sheet extending from one longitudinal edge thereof toward the other and terminating short of the other to define said mounting portion, each said slit extending at an angle to said mounting portion of between 45° to 70°, each said fin having a fin span along said one side edge of said mounting portion, each said fin further having an acute fin edge intersecting said one side edge at an acute angle and an opposite obtuse fin edge intersecting said one side edge at an obtuse angle, each said fin being bent along a first bend line extending generally from the intersection of said acute fin edge with said span to an intersection point with said obtuse fin edge which is spaced outwardly from said span, and each said fin being bent along a second bend line defined by said span.

9. A free convection type heat exchange enhancement structure comprising: a substantially flat cylindrical mounting portion having opposite circular edges and a longitudinal mounting portion axis; a plurality of fins integral with said mounting portion, each said fin having a longitudinal fin axis, opposite substantially straight and parallel fin edges, a predetermined thickness, and a predetermined width across said fin edges perpendicular to said longitudinal fin axis; said fins being bent outwardly from at least one of said circular edges of said mounting portion to have said opposite fin edges lying generally on the surfaces of different cones having cone axes coincidental with said longitudinal mounting portion axis and having cone apices spaced from one another along said longitudinal mounting portion axis a distance substantially greater than said predetermined thickness of each said fin and substantially less than said predetermined width of each said fin; said location of said fins, when said mounting portion is in heat transfer relationship to a pipe with said longitudinal mounting portion axis extending substantially vertically, providing each said fin with a position downwardly inclined and rotated about said longitudinal fin axis whereby air flowing upwardly through said fins is imparted with rotation and outward movement relative to said mounting portion axis.

10. The heat exchange ehancement structure as defined in claim 9 wherein said mounting portion has opposite ends and integral mounting means on said mounting portion spaced inwardly from said ends for cooperation with a mounting device for holding said mounting portion in tension around a pipe.

11. The heat exchange enhancement structure as defined in claim 9 wherein each said fin is bent along two different straight lines.

12. The heat exchange enhancement structure as defined in claim 9 including a generally vertically disposed cylindrical pipe on which said mounting portion is received with the apices of said cones pointing upwardly.

13. The heat exchange enhancement structure as defined in claim 12 wherein said cones slope upwardly from their bases toward their apices at angles between 5° and 30°.

14. A free convection type heat exchange enhancement structure comprising: an elongated flat mounting portion having opposite side edges; a plurality of fins integral with said mounting portion and extending outwardly from at least one of said side edges thereof; each said fin having a longitudinal axis and opposite fin edges, each said fin being bent across the width thereof between said fin edges along a substantially straight line bend which extends at an included acute angle to said one side edge of between 50°–80°; each said fin having a first fin portion on the side of said bend toward said mounting portion and a second fin portion on the opposite side of said bend; said second fin portion being bent through an angle of 45°–75° with respect to said first fin portion; and, each said first fin portion being bent along said one side edge of said mounting portion through an angle of 55°–85° in the same direction with respect to said mounting portion as the direction in which said second fin portion is bent with respect to said mounting portion.

* * * * *